United States Patent [19]

Nishiyama et al.

[11] Patent Number: 4,746,176

[45] Date of Patent: May 24, 1988

[54] TOWEL DISPENSER

[75] Inventors: Masanobu Nishiyama; Haruo Nishimura, both of Osaka; Katsuji Nakano, Nishinomiya; Tatsuo Ozaki; Teruo Yamada, both of Kyoto; Koichi Nakagawa, Kobe; Akira Kitamoto, Ikoma, all of Japan

[73] Assignees: Duskin Co., Ltd., Osaka; Matsushita Electric Industrial Co., Ltd, Kadoma, both of Japan

[21] Appl. No.: 947,779

[22] Filed: Dec. 30, 1986

[51] Int. Cl.[4] ..... B65H 19/10

[52] U.S. Cl. ..... 312/38

[58] Field of Search ..... 312/37, 38, 39; 160/323 B

[56] References Cited

U.S. PATENT DOCUMENTS

| | | | |
|---|---|---|---|
| 1,062,943 | 5/1913 | Adams | 312/38 |
| 1,245,585 | 11/1917 | Haus et al. | 160/323 B |
| 1,353,416 | 9/1920 | Orcutt | 312/38 |
| 4,010,988 | 3/1977 | Schwartz | 312/38 |
| 4,573,750 | 3/1986 | Golby | 312/38 |

*Primary Examiner*—Joseph Falk

*Attorney, Agent, or Firm*—Cushman, Darby & Cushman

[57] ABSTRACT

The towel dispenser adapted to store and supply a towel of undeterminate length. At least one of the unused and used portions of the towel is stored in the form of a roll on a shaft. The towel dispenser includes a pair of side walls each having at least one elongated hole. The portion of the side wall defining the inner peripheral edge of the elongated hole is obliquely bent towards each respective other side wall so as to form a tab projecting towards the other side wall. Each end of the shaft is rotatably and slidably received in the respective elongated hole defined by the respective tab, in such a manner that each end of the shaft does not project beyond the plane of the associated side wall.

5 Claims, 17 Drawing Sheets

| | | |
|---|---|---|
| FIG.12(A) | FIG.12(B) | FIG.12(C) |

TOWEL DISPENSER

BACKGROUND OF THE INVENTION

1. Field of the Invention

The present invention relates to a towel dispenser which is capable of supplying and taking up a sheet towel of indeterminate length very accurately.

2. Description of the Prior Art

Towel dispensers are known which hold a roll of towel in such a manner as to enable the user to pull and unroll the towel while automatically taking up the used portion of the towel.

In known towel dispensers of the type described, the portion of the towel which has been pulled out and used is suspended and slackened in the form of a loop below the dispenser. Such a slack of the towel imparts an unpleasant feel to the users and is quite unsanitary because of various contaminants attaching thereto.

In order to avoid this problem, a towel dispenser has been proposed in which the loop portion of the towel is automatically taken up in a predetermined time after the use.

This improved towel dispenser, however, still suffers from various drawbacks or shortcomings as stated hereinbelow.

A first problem arises from the construction for supporting a take-up shaft for taking up the used towel. In the above-mentioned improved towel dispenser, both ends of the take-up shaft are slidably and rotatably received in elongated holes formed in opposing side walls of the towel dispenser. As the amount of the used towel portion taken-up by the shaft becomes large, the diameter of the roll of the used towel on this shaft is increased correspondingly. Therefore, both ends of the take-up shaft are progressively slid in the elongated holes to enable the used towel to be taken up over its full length. Both ends of the take-up shaft are projected through the elongated holes to the exterior of the space defined by the side walls, so that there is a risk for the ends of the take-up shaft to interfere with electronic parts and other associated parts outside the side walls. It is, therefore, necessary that the electronic parts and other parts are spaced apart from the side walls, with the result that the size of the towel dispenser as a whole is increased undesirably.

In addition, an end surface of the roll of the used towel tends to contact with the surface of the adjacent side wall, so as to brake the roll during the take-up. Conversely, when there are large gaps between the end surfaces of the roll of the used towel and the side walls, the roll is collapsed in the axial direction so that the appearance is deteriorated seriously.

A second problem is that, since the towel has to move along a complicated path before reaching the take-up roller, a laborious work is required for mounting a new towel in such a manner as to clear the shaft on which the towel is mounted.

A third problem is as follows. The above-mentioned improved towel dispenser has a roller which corresponds to a later-mentioned taxi roller used in the towel dispenser of the present invention. This roller suspends the towel and moves up and down thereby retracting the used towel.

This roller, however, is a free roller which is merely mounted for free rotation so as to be driven by the towel which frictionally engages the roller. The roller, therefore, tends to fail to take-up the towel smoothly.

Namely, the space in which the roller moved up and down is extremely small, so that the towel suspending from the roller tends to contact a wall on the rear side of the roller. This in turn causes a problem that, when the roller has come down, the towel remains in the gap so that the towel cannot be fully paid-off even after the roller has come down to its lower stroke end. In order to overcome this problem, it is necessary to increase the space size between the roller and the plate on the rear side of the roller. This results in an increase of the size of the towel dispenser as a whole.

A fourth problem resides in that, since the taxi roller is received at its both ends in elongated holes only for vertical movement along these elongated holes, the work for renewing the towel is very troublesome because the taxi roller is movable only in the vertical direction.

A fifth problem is that the taxi roller tends to be loaded unduly because the user, who is unfamiliar with the operation of the towel dispenser, may wrongly pull the towel while the towel is being retracted by upward movement of the taxi roller. In consequence, there is a risk that the towel dispenser is broken by such an extraordinary load.

SUMMARY OF THE INVENTION

Accordingly, an object of the present invention is to provide a towel dispenser which is improved in such a way as to overcome the first problem mentioned before.

To this end, according to one aspect of the present invention, there is provided a towel dispenser adapted to store and supply a towel of indeterminate length, at least one of the unused and used portions of the towel being stored in the form of a roll on a shaft, the towel dispenser comprising: a pair of side walls each having at least one elongated hole, the portion of the side wall defining the inner peripheral edge of the elongated hole being obliquely bent towards the other side wall so as to form a tab projecting towards the other side wall, each end of the shaft being rotatably and slidably received in the elongated hole defined by the tab, in such a manner that the end of the shaft does not project beyond the plane of the associated side wall.

With this arrangement, both axial ends of the shaft carrying the roll of the used portion of the towel and/or the shaft carrying the unused portion of the towel are supported by tabs which are bent inwardly from both side walls and, therefore, do not project beyond the side walls, so that electronic and mechanical parts can be mounted on the outer surfaces of the side walls densely. In addition, the inwardly bent tabs serve as ribs so that mechanical strength of the side walls are appreciably increased. This shaft supporting structure can be used for the purpose of supporting a roll of towel, regardless of whether the towel dispenser is of manual operation type or electrically driven type.

It is to be understood also that, since the end surface of the rolled towel is contacted only by the adjacent tab, the frictional resistance against the rotation is remarkably reduced as compared with the known arrangement in which the whole area of the roll end surface is contacted by the adjacent side wall. Furthermore, the tabs effectively prevent the roll from being axially collapsed, thus enabling the towel to be rolled in a neat form with flattened axial end surfaces.

According to a second aspect of the present invention, there is provided a towel dispenser adapted to store and supply a towel of indeterminate length, at least one of the unused and used portions of the towel being stored in the form of a roll on a shaft, the towel dispenser comprising: a towel receiver disposed on the main part of the towel dispenser and adapted to be opened and closed, the towel receiver accommodating the roll of the towel; a vertically movable taxi roller for retracting and delivering the used portion of towel; a take-up shaft for taking-up the used portion of towel; an adjusting roller disposed between the taxi roller and the take-up shaft; and a pair of rotary plates between which the adjusting roller is laid horizontally, the towel receiver being operatively connected to the rotary plates.

With this arrangement, when the towel is to be replaced, the adjusting roller is moved to a position where it does not hinder the placement of the towel around various shafts, by widening the space through which the towel is set. In consequence, the mounting of new towel is very much facilitated to enable even a person who is unfamiliar with this machine, According to a third aspect of the present invention, there is provided a towel dispenser having a vertically movable taxi roller adapted to retract and deliver used portion of a towel of indeterminate length, comprising: friction members arranged along the path of movement of the taxi roller; and resilient means for resiliently pressing the friction members into contact with the taxi roller thereby causing the taxi roller to be forcibly driven when moving up and down.

With this arrangement, the taxi roller is forcibly driven upon frictional engagement with the friction members, so as to retract or deliver the towel forcibly, thus enabling the towel to be retracted and delivered smoothly. In addition, even when the towel dispenser has a rear wall which is positioned in the close proximity of the towel, i.e., even when the towel is obliged to move up and down through an extremely small gap, the undesirable separation of the towel from the taxi roller and consequent stagnation in the narrow space is avoided, thanks to the fact that the taxi roller is driven forwardly and backwardly so as to forcibly supply and retract the towel. This in turn enables the above-mentioned gap to be reduced, thus allowing the towel dispenser as a whole to have a reduced size.

According to a fourth aspect of the present invention, there is provided a towel dispenser adapted to store and supply a towel of indeterminate length, at least one of the unused and used portions of the towel being stored in the form of a roll on a shaft, the towel dispenser comprising: a towel receiver disposed on the main part of the towel dispenser and adapted to be opened and closed, the towel receiver accommodating the roll of the towel; a vertically movable taxi roller for retracting and delivering the used portion of towel; and a pair of rotary frames carrying the taxi roller vertically movably and pivotally secured to upper portions of the main part, the towel receiver and the rotary frames being operatively connected to each other.

With this arrangement, the rotary frames supporting the taxi roller are moved together with the taxi roller, so as to facilitate the placement of the new towel around various shafts and rollers.

According to a fifth aspect of the present invention, there is provided a towel dispenser having a vertically movable taxi roller adapted to retract and deliver used portions of a towel of indeterminate length, comprising: a pair of rotary frames rotatably secured to upper end portions of the main part of the apparatus and vertically movably carrying the taxi roller; a mechanism for rotating the rotary frames when a tension is applied to the towel; and a switch adapted to be operated by rotation of the rotary frames, so as to stop the supply of the power to a motor for driving the taxi roller.

With this safety arrangement, when an undue force is applied to the towel, the motor is stopped to prevent movement of the taxi roller, so that the driving system including the motor is protected against overload.

The above and other objects, features and advantages of the present invention will become clear from the following description of the preferred embodiments taken in conjunction with the accompanying drawings.

BRIEF DESCRIPTION OF THE DRAWINGS

The attached FIGURES show a preferred embodiment of the present invention in which:

FIGS. 13A, 13B to 17A, 17B are side elevational views and longitudinal sectional views illustrating respective steps of operation;

DESCRIPTION OF THE PREFERRED EMBODIMENT

Figure 1:
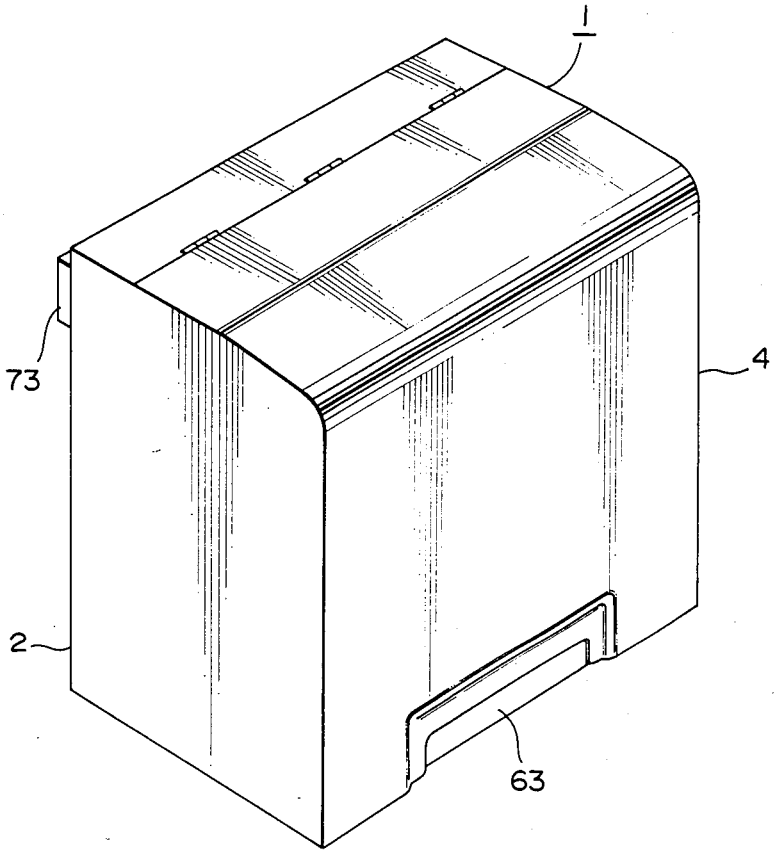
FIG. 1 is a perspective view of the whole portion of a towel dispenser embodying the present invention.
Figure 2:
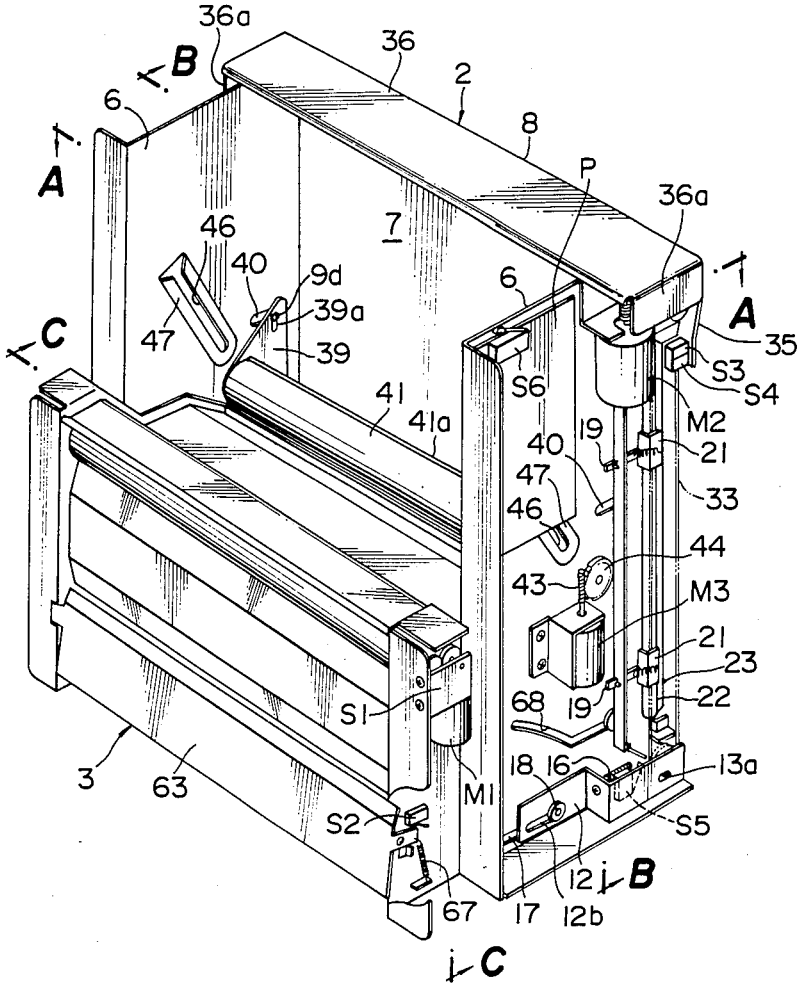
FIG. 2 is a perspective view of the towel dispenser with its cover removed.

A preferred embodiment of the present invention will be described hereinunder.

A towel dispenser 1 in accordance with the present invention has a main part 2, a towel receiver 3 disposed rotatably under and in front of the main part 2, a cover 4 hinged to the upper end of the main part 2 and capable of covering the front side of the dispenser, and a mounting plate 5 for mounting the main part 2 on, for example, a wall of a room.

The main part 2 has frame 8 constituted by both side walls 6,6 and a rear wall 7 which are assembled to provide a ]-shaped cross-section which is opened at its front side. Rotary frames 9,10 are disposed on the outer side of the side walls 6, 6 adjacent to the rear wall. The rotary frames 9, 10 are elongated frames elongated in the vertical direction. One 9 of the rotary frame is provided on the upper end thereof with a widened tab 11 having a ]-shaped cross-section directed outwardly.

An outward bend 9a is formed along the front side edge of the rotary frame 9 over the entire length of the latter. At the same time, an outward bend 9b having a form like L is provided on the lower end of the rotary frame 9. A frame 12 has one end which is disposed along the outer edge of the bend 9b.

Figure 3:
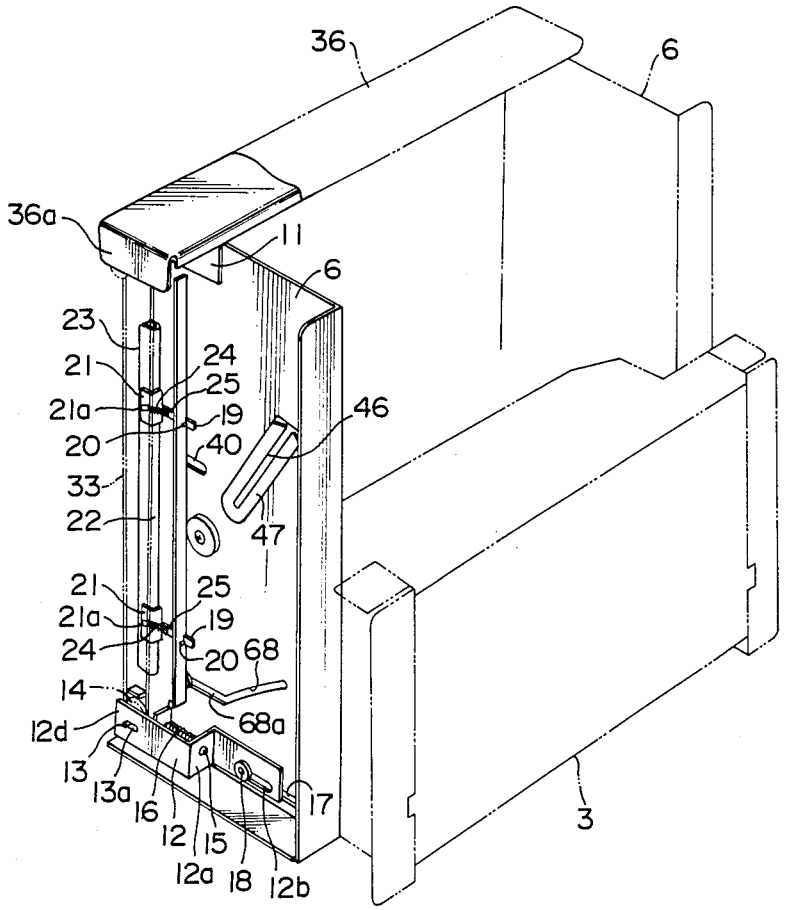
FIG. 3 is a perspective view illustrating the manner in which a rotary frame is mounted.

The frame 12 is formed by bending a web or sheet of metal at an intermediate portion thereof with a bend having a 90° step. A shaft 13 is horizontally laid so as to extend between a widened portion 9C on the lower end of the rotary frame and one end 12d of the frame 12. As will be seen from FIG. 3, the outer end of the shaft 13 is slidably received in an axial elongated hole 13a formed in the rear end of the frame 12. The shaft 13 rotatably carries a chain sprocket 14 disposed between the frame 12 and the widened portion of the lower end of the rotary frame 9.

A shaft 15 has one end fixed to the intermediate bend 12a of the frame 12 and the other end projected towards the bend 9b on the lower end of the rotary frame 9.

A spring 16 is wound on the shaft 15 and is loaded between the bend 9b and the frame 12, thus urging the bends 12a and 9b away from each other.

An axially extending elongated hole 12b is formed in the front end of the frame 12. An elongated hole 17 corresponding to the elongated hole 12b is formed in the lower end of the side wall 6. A shaft 18 is inserted into the elongated holes 12b and 17 from the outside of the frame 12 and is fixed to the side wall of a towel receiver which will be mentioned later. Upper and lower sliding plates 19, 19 slidably extend through the base portion of the bend 9a formed on the side edge of the rotary frame 9, perpendicularly to the axis of the rotary frame 9.

A pin 20 serving as a stopper is provided on the front end of each sliding plate 19 so as to project at the outside of the bend 9.

The intermediate portion of the sliding plate 19 slidably extends through the base of a tab 21 which is cut and raised from the rotary frame 9 so as to have an L-shaped cross-section, and is fixed, at its portion beyond the tab 21, to a bent portion of an elongated supporting frame having a U-shaped cross-section and disposed in parallel with the rotary frame 9. A friction member 23 made of a frictioning material such as rubber is fixed in the supporting frame 22 over the entire length of the supporting frame 22.

The friction member 23 projects rearwardly from the apparatus.

The length of the friction member 23 is smaller than the length of the rotary frames 9 and 10.

A spring 24 is stretched between the tab 21 and the sliding plate 19 so as to urge the friction member 23 rearwardly. A reference numeral 25 denotes a small screw by which one end of the spring 24 is fixed to the sliding plate 19 while the other end of the spring 24 is fixed to a spring retainer 21a which is cut and raised from the tab 21.

The described arrangement secures the friction member 23 to the rotary frames 9, 10. With this arrangement, the friction member 23 frictionally engages with a later-mentioned taxi roller, thereby forcibly driving the taxi roller. The described construction for frictionally driving the taxi roller is only illustrative. Namely, the arrangement may be such that vertical rear edges of the rotary frames 9, 10 are widened rearwardly so as to contact the taxi roller directly or indirectly through a rubber member provided on the rear edges and serving as a friction member, so that the taxi roller is forcibly rotated as it is moved up and down in rolling frictional contact with the rear edges of the rotary frames 9, 10 or the friction member thereon.

The base portion of the L-shaped bend 11 is rotatably supported by a pin 26 which is provided on the outer surface of the upper end of the side wall 6.

The positions of the pins 26 which constitute the pivots of the rotary frames 9, 10 are offset horizontally forwardly from the position of a taxi roller which will be mentioned later. The offset of the positions of the pins 26 produces an effect that, when the taxi roller is urged downward by the tension of the towel wound on the taxi roller, the rotary frame 9, 10 are rotated about the pins 26 such that their lower ends are swung forwardly. The arrangement is such that the rotary motion of the rotary frames 9, 10 causes a later-mentioned switch S5 to be turned on, thereby stopping a driving motor. The rotary motion of the rotary frame also causes a later-mentioned rotary plate to be rotated, so that an adjusting roller connected to the rotary plate is moved rearward. This rearward movement of the adjusting roller promotes the swinging motion of the rotary frames 9, 10, so that the switch S5 can be turned on without fail.

The other rotary frame 10 has a construction which is substantially the same as that of the rotary frame 9 except the following points. Namely, the rotary frame 10 is provided on the upper end thereof with a ]-shaped supporting frame which is opened towards the outside. An outwardly directed bend 10a is formed along the front edge of the rotary frame 10. A bent portion 10b is formed on the front side of the lower end of the rotary frame 10.

A frame 12 having the same construction as the frame 12 associated with the rotary frame 9 is arranged along the outer edge of the bend 10b in symmetry with the frame 12 associated with the rotary frame 9. A shaft 13 is laid between the rear end of the frame 12 and the lower end of the rotary frame 10. The outer end of the shaft 13 is slidably received in an elongated hole 13a formed in the rear end of the frame 12. This shaft 13 also rotatably carries a chain sprocket 14.

A shaft 15 has one end fixed to a flat bent intermediate portion 12a of the frame 12. The other end of the shaft 15 extends towards the bend 10b. A spring 16 wound on the shaft 15 urges the bends 12a and 10b away from each other. A supporting frame 22 to which the friction member 23 is fixed is secured also to the rotary frame 10. The mounting structure and the form of the supporting frame 22 are the same as those of the supporting member 22 explained before in connection with the rotary frame 9. The construction of this supporting frame 22, therefore, is not described in detail with the same or the like numerals used to denote the same or like parts.

An elongated hole 12b is formed on the front end of the frame 12 adjacent to the frame 12. An elongated hole 17 is formed in the lower end of the side wall 6, so as to oppose to the elongated hole 17. A shaft 18 is inserted into these elongated holes 12b and 17 from the outside, and is fixed to the side plate of a later-mentioned towel receiver 3.

A limit switch S5 is secured to the inner side of the rear half part of the frame 12 in the vicinity of the bend 12*a* of the frame 12 adjacent to the rotary frame 10. As will be explained later, the limit switch S5 detects the state of rotation of the rotary frame 10.

A printed circuit board P mounting an electronic circuit for controlling the whole operation is fixed to the outer surface of the side wall 6 of the rotary frame 10.

To the upper end of the rotary frame 10 is fixed a motor M2 with its shaft extended in parallel with the axis of the rotary frame 10.

Figure 9:
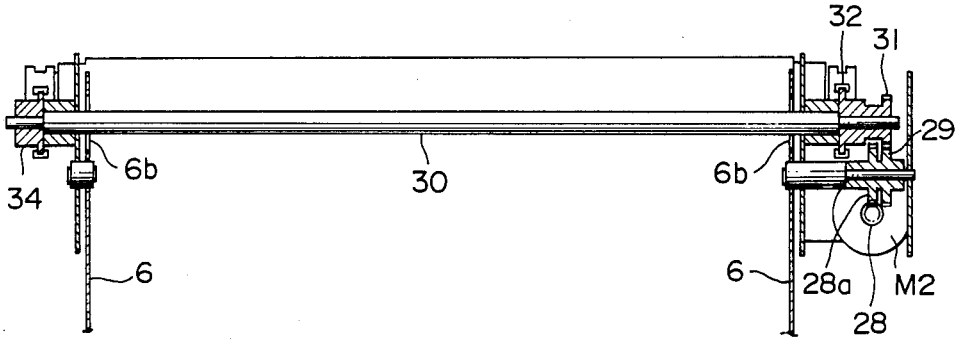
FIG. 9 is a sectional view taken along the line A—A of FIG. 2.
Figure 10:
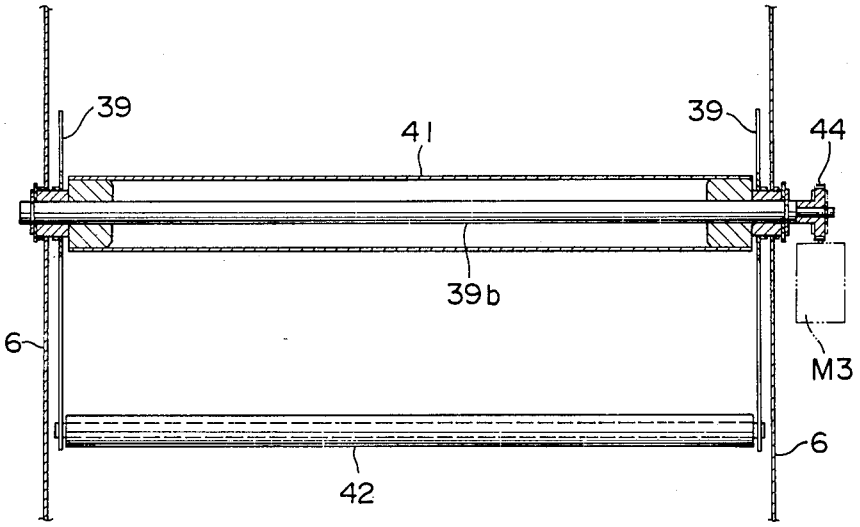
FIG. 10 is a sectional view taken along the line B—B of FIG. 2.
Figure 11:
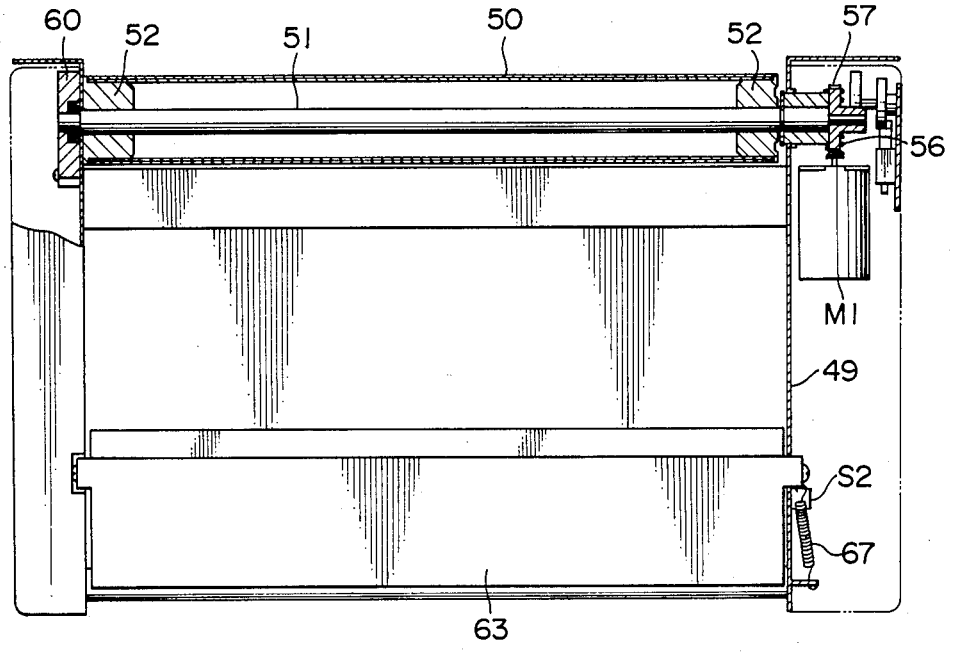
FIG. 11 is a sectional view taken along the line C—C of FIG. 2.

A worm gear 28 fixed to the output shaft of the motor M2 projects into the space in a ]-shaped supporting frame 27, and meshes with a worm wheel 28*a* which is rotatably supported by the vertical wall of the supporting frame 27.(see FIG. 9)

A gear 29 which is integral with the worm wheel 28*a* meshes with a gear 31 which is fixed to one end of a shaft 30 penetrating the vertical wall of the supporting frame 27.

An endless rudder chain 33 is stretched between a chain sprocket 32 integral with the gear 31 and a chain sprocket 14 provided on the lower end of the rotary frame 10.

The other end of the shaft 30 extends through the upper end of the rotary frame 9. A chain sprocket 34 is fixed to the end of the shaft 30 extending beyond the rotary frame 9.

Another endless rudder chain 33 is stretched between the chain sprocket 34 and the chain sprocket 14 which is provided on the lower end of the rotary frame 9.

Therefore, the rotation of the rotor shaft of the motor M2 is transmitted to the shaft 30 through the worm gear 28, worm wheel 28*a*, and gears 29, 31, so that the chain sprockets 32, 34 are rotated to run the rudder chain 33.

The rotary frames 9 and 10 are rotated about the pins 26, 26 as will be explained later. In consequence, the shaft 30 which is integral with the rotary frames 9, 10 also are rotated.

Notches 6*b*, 6*b* are formed in the inner upper end portions of the side walls 6, 6 so that the side walls 6, 6 do not interfere with the shaft 30 when the latter rotates.

A supporting plate 35 is fixed at its upper end to the underside of the rear end of the supporting frame 27 on the upper end of the rotary frame 10. Limit switches S3 and S4 are fixed to the lower end of the supporting plate 35 and are directed towards the rudder chain 33.

The bend 11 and the supporting frame 27 on the upper ends of the rotary frames 9, 10 project beyond and above the upper ends of the side walls 6, 6, while a top plate 36 is fixed to the upper surfaces of the bend 11 and the supporting frame 27.

The top plate 36 covers the rear side of the upper end of the frame 8. Flaps 36*a* formed on both ends of the top plate 36 are positioned outside the bend 11 and the supporting frame 27.

A taxi roller 38 is fixed at its both ends, through fixing members 37, to the portions of the pair of rudder chains 33, 33 adjacent to the rear end of the side walls 6, 6.

The outer peripheral surface of the taxi roller 38 is covered by a friction member such as of a rubber. Both ends of the taxi roller 38 are received in elongated vertical notches 6*c*, 6*c* formed in the rear edges of the side walls 6, 6. The lower ends of the notches are cut deeper into the side walls 6,6 so as to provide recesses 6*d* continuous from the notch 6*c*.

The taxi roller 38, when moving up and down, contacts with a frictional member 23 secured to the rotary frames 9, 10, so as to be frictionally driven by the frictional member 23.

Figure 8:
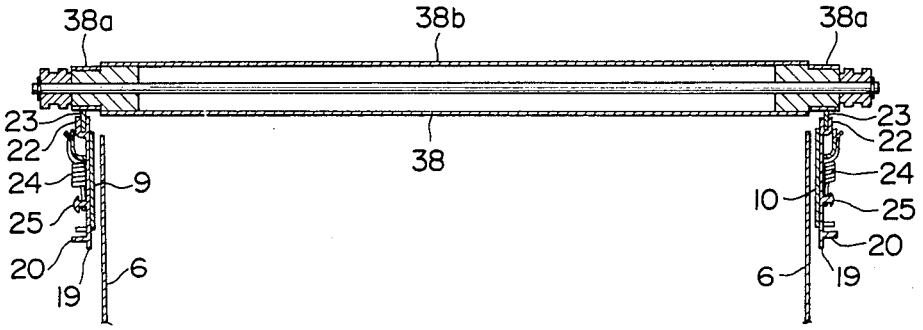
FIG. 8 is a sectional view taken along the line D—D of FIG. 6, illustrating the construction for mounting a taxi roller.

As will be understood from FIG. 8, the diameter of the cross-section of the taxi roller 38 is smaller at both axial ends 38*a*, 38*a* than at the central portion 38*b*. Since the ends 38*a*, 38*a* of the smaller diameter frictionally engage with the friction members 23, 23, the central portion 38*b* of the taxi roller 38 rotates at a high peripheral speed. In consequence, the towel can be quickly taken-up by or unrolled from the central portion 38*b*.

The friction members 23 is always urged by the springs 24 into contact with the taxi roller 38. However, the springs 24 are intended merely for ensuring the contact between the friction members 23 and the taxi roller 38. Thus, the springs 24 can be dispensed with if the members are adequately sized to ensure the contact.

When the rear end edges of the rotary frames 9, 10 are used as the friction members 23, both ends 38*a*, 38*a* of the taxi rollers 38 frictionally engage with these rear end edges so as to be forcibly rotated by the latter, so that the central portion 38*b* of the taxi roller is rotated at a high peripheral speed. Substantially triangular rotary plates 39 are pivotally secured at their mid portions through pivot shafts 39*b*. The pivot shafts 39*b* of the rotary plates 39 serve also as supporting shafts for supporting a take-up roller 41. An arcuate guide plate 41*a* is disposed on the rear side of the take-up roller 41 so as to extend along the circumference of the take-up roller 41.

Vertical elongated holes 39*a* are formed in the upper ends of the rotary plates 39. Horizontal elongated holes 40, 40 formed in the side walls 6, 6 overlap the upper ends of the elongated holes 39*a*.

Pins 9*d*, 10*d* projecting inwardly from the inner surfaces of the rotary frames 9, 10 slidably fit in the elongated holes 39*a*, 40.

An adjusting roller 42 is extended horizontally between the lower ends of the rotary plates 39, 39.

A motor M3 is mounted on the outer surface of either one of the side walls 6, such that its shaft extends vertically. A worm gear 43 fixed to the output shaft of the motor M3 meshes with a worm wheel 44 which in turn is fixed to the outer end of the shaft 39*b* of the roller 41. Therefore, as the motor M3 operates, the take-up roller 41 is rotated through the worm gear 43 and the worm wheel 44, so that the rolled towel is taken up.

Elongated holes 46 for receiving both ends of the take-up shaft 45 of the used towel are formed in mid portions of the side walls 6, 6 so as to extend obliquely downwardly and rearwardly. The portions of each side wall 6, 6 constituting the peripheral edges of the elongated hole 46 are bent inwardly so as to form tabs 47 which are inclined with respect to the plane of the elongated hole 46. According to this arrangement, the elongated hole 46 is positioned inside the side wall 6 and the upper end of the elongated hole 46 is opened. For the purpose of placing the take-up shaft 45 for taking up the used towel, therefore, the shaft 45 is merely inserted through the open upper end of the elongated hole 46 and slid into the latter. After the placement of the shaft 45, therefore, the ends of the take-up shaft 45 do not project outward beyond the planes of the side walls 6. This in turn makes it possible to arrange various parts on the outer surfaces of the side walls 6, 6, so that the area of the outer surface of each side wall 6 is effectively utilized contributing to the reduction in the size of the whole apparatus. The reduction in the size is ensured also by the fact that both ends of the shaft 45 do not project beyond the planes of the side walls 6. Furthermore, the tabs serve as ribs which enhance the mechanical strength of the side walls. It is to be understood also that, since the axial end of the roll of the used towel is contacted only by the tabs, the friction between the roll of the towel and the tabs is remarkably increased as compared with the conventional arrangement in which the end surface of the roll makes a surface contact with the side wall, so that the taking-up of the used towel is facilitated. Furthermore, the tabs on both side walls restrains the end surfaces of the rolled towel, so that the used towel can be taken up and rolled in such a neat manner with both axial ends kept flat.

Figure 5:
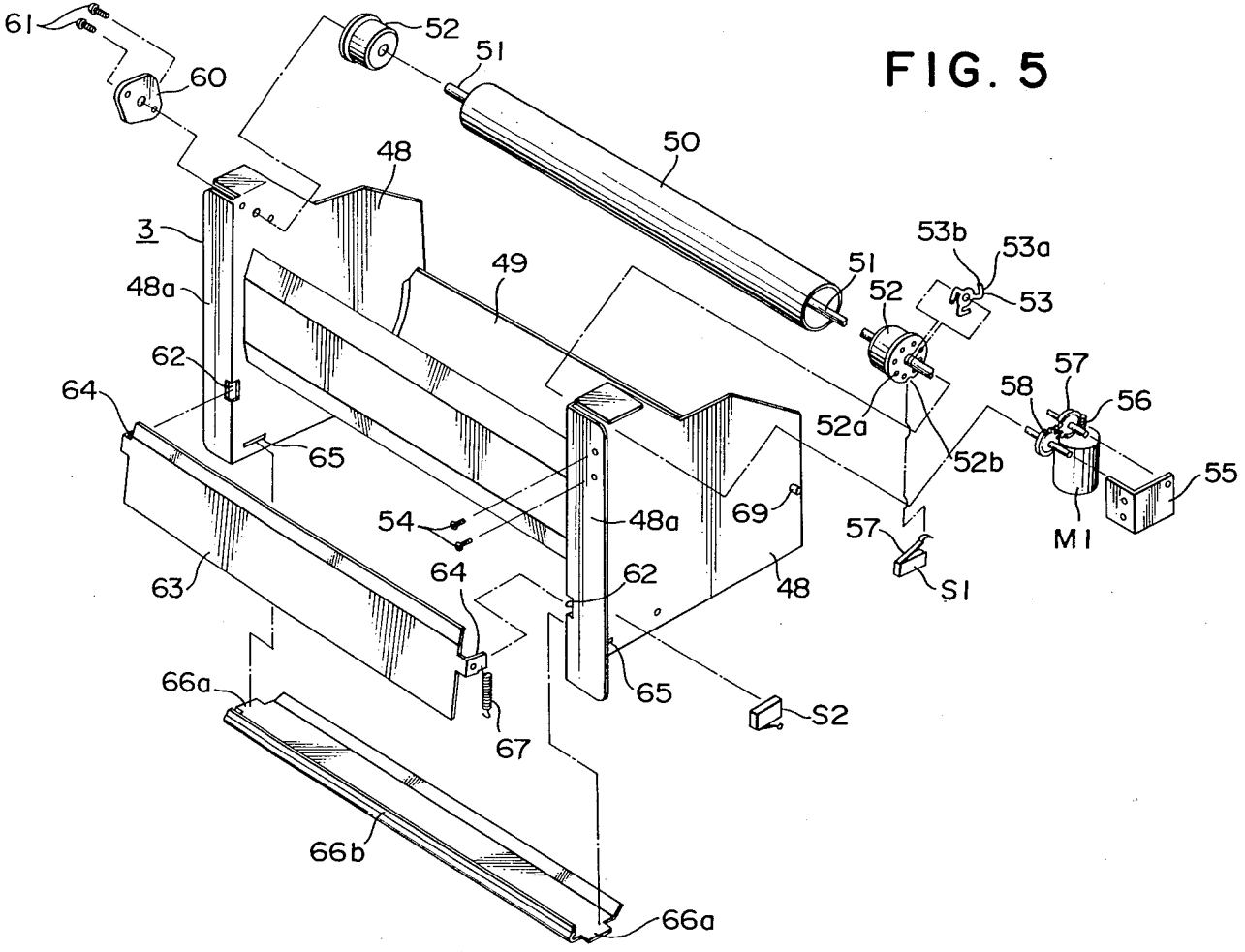
FIG. 5 is an exploded perspective view of a towel receiver.
Figure 6:
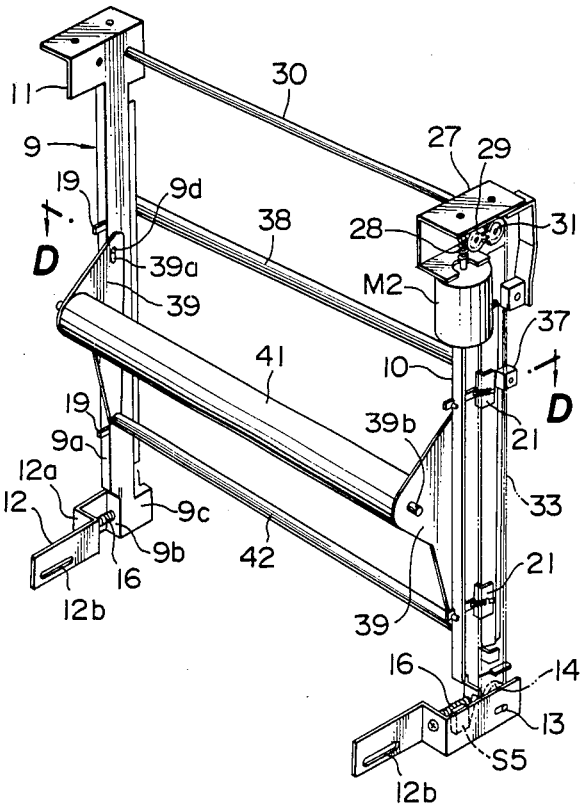
FIG. 6 is a perspective view showing the manner in which the rotary frame and rotary plate are attached.
Figure 7:
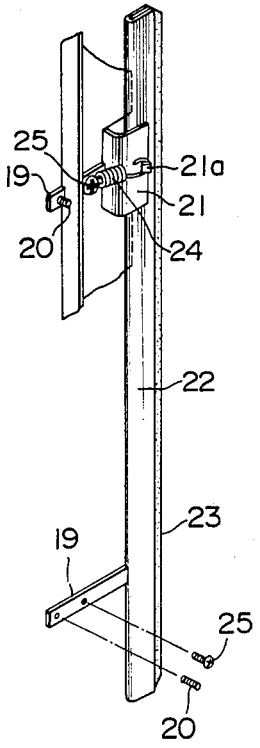
FIG. 7 is a perspective view illustrating the manner in which a friction member is attached.

On the other hand, the towel receiver 3 has a construction as shown in FIG. 5.

Namely, the towel receiver 3 is provided with both side walls 48, 48 and a supporting frame disposed between both side walls 48, 48 and having an arcuate cross-section. The supporting frame 49 is laid horizontally with its opening directed towards the roller 41.

A supply roller 50 is rotatably carried by front upper end portions of the side walls 48, 48. A supporting shaft 51 is extended through the supply roller 50. Bushes 52 rotatably carried by the supporting shaft 51 fit on both ends of the supply roller 50.

A plurality of small holes **52*a* are formed on the outer side surface of one of the bushes 52. A clutch plate 53 is fixed to the supporting shaft 51 at the outer side of the bush 52**.

The clutch plate 53 is formed by punching out a leaf spring so as to have a plurality of arms **53*a*. Projections 53*b* formed on the arms 53*a* are adapted to fit in the small holes 52*a*. When the supporting shaft 51 rotates counterclockwise as viewed in FIG. 5, the projections fit in the small holes 52*a* so that the supply roller 50 is rotated in the direction for supplying or feeding the towel. However, the clutch plate 53 slips when the supporting shaft 51 is rotated in the reverse direction or when the supply roller 50 solely rotates in the counterclockwise direction while the supporting shaft 51** is kept stationary.

A supporting plate 55 is fixed by screws 54 to the inner surface of an outward bend **48*a* formed along the front side edge of one of the side plates 48**.

A motor M1 is secured to the outer side of the side panel 48 and is disposed inside the supporting plate 55. The motor M1 has an output shaft which carries a worm gear 56 meshing with a worm wheel 57 which is rotatably disposed between the supporting plate 55 and the side panel 48. The worm wheel 57 meshes with a gear 58 which is fixed to the outer end of the supporting shaft 51. Therefore, as the motor M1 operates in the towel supplying direction, the supply roller 50 is rotated through these gears 56, 57 and 58.

An arcuate recess **52*b* constituting a cam is formed on the central portion of the outer surface of the bush 52. A limit switch S1 has an actuator the free end of which drops in the recess 52*b*** so as to detect the state of supply of the towel.

In FIG. 5, a reference numeral 60 designates a bearing member which supports the other end of the supporting shaft 51 and fixed to the outer surface of the side panel 48 by means of screws 61.

An opening 62 is formed in the corner of the lower end portion of a bend **48*a* formed along the front edge of each side panel 48 of the towel receiver. The openings 62 receive bends 64 which are provided on both ends of a switch plate 63. The breadth of the bend 64 is smaller than the breadth and height of the opening 62, so that the bend can rotate within the opening 64**.

Horizontal slots 65 are formed in the lower front end portions of the side walls 48, 48. A frame plate 66 has both ends **66*a* received in these slots 65 and bent onto the side walls 48. An upward bend 66*b* on the front end of the frame plate 66 serves as a stopper for limiting the rotation of the switch plate 63**.

Springs 67 are stretched between the lower ends of the side walls 48 and adjacent tabs 64 on both ends of the switch plate 63, so as to urge the switch plate 63 clockwise a viewed in FIG. 5.

Furthermore, a limit switch S2 is secured to the outer surface of the side panel 48 above the bend 64, in order to detect the pressing of the switch plate 63. A limit switch S6 for detecting opening and closing of the cover 4 is provided on the upper end of the side wall 6.

The towel receiver having the described construction is disposed in the space between the side walls 6, 6 of the frame 8 of the main part 2, and is secured by screws 18 which are screwed into threaded holes **48*b* formed in the side walls 48 through the elongated holes 12*b* in the frames 12 and the elongated holes 17 in the side walls 6**.

A cover **3*a* is secured to the upper side of the towel receiver 3 so as to keep the unused new portion of the towel and the used portion of the towel out of contact each other and to prevent any contaminant on the used towel portion from dropping onto the used towel portion. Elongated holes 68 are formed in the lower portions of the respective side walls 6, 6**.

Each of the slots 68 has a horizontal straight rear portion **68*a* and an arcuate front portion 68*b* which ascends forwardly. The slots 68 slidably receive pins 69 which are projected from the outer surfaces of the side walls 48 of the towel receiver 3** at rear central portions of the respective side walls.

A roll 70 of unused towel is received in the space defined by the supporting frame 49 of the thus constructed towel receiver 3.

Figure 21:
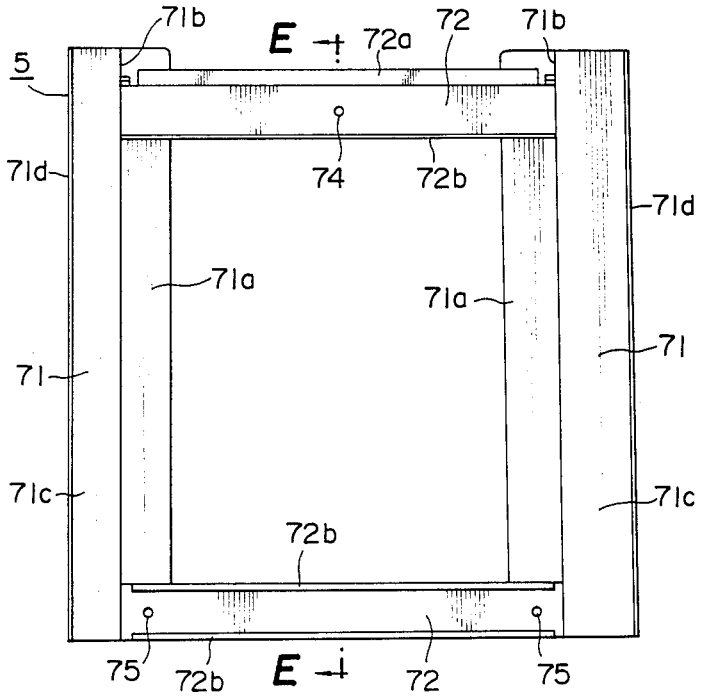
FIG. 21 is a front elevational view of a mounting plate.
Figure 22:
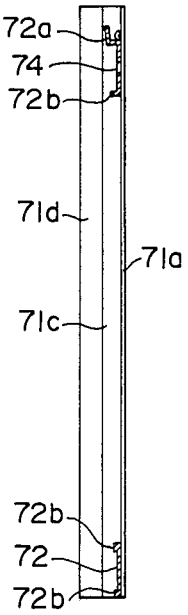
FIG. 22 is a sectional view taken along the line E—E of FIG. 21.

On the other hand, the mounting plate 5 is constructed as a quadrilateral frame as shown in FIG. 21, and is composed of a pair of vertical frame members 71, 71 and a pair of horizontal frames 72, 72 which are formed by press work from metal sheets.

The vertical frames 71, 71 are shaped and arranged in symmetry with each other and a first flat portion **71*a* is formed along the inner side of each of them over the entire length thereof. A second flat portion 71*c* extends along and connected to the outer end of each first flat portion 71*a* through a step 71*b***.

The distance between the steps **71*b*, 71*b* which define the outer edges of the first flat portions 71*a*, 71*a* is substantially equal to the length of a frame member 73 which is provided on the rear side of the upper end portion of the frame member 8**.

Figure 4:
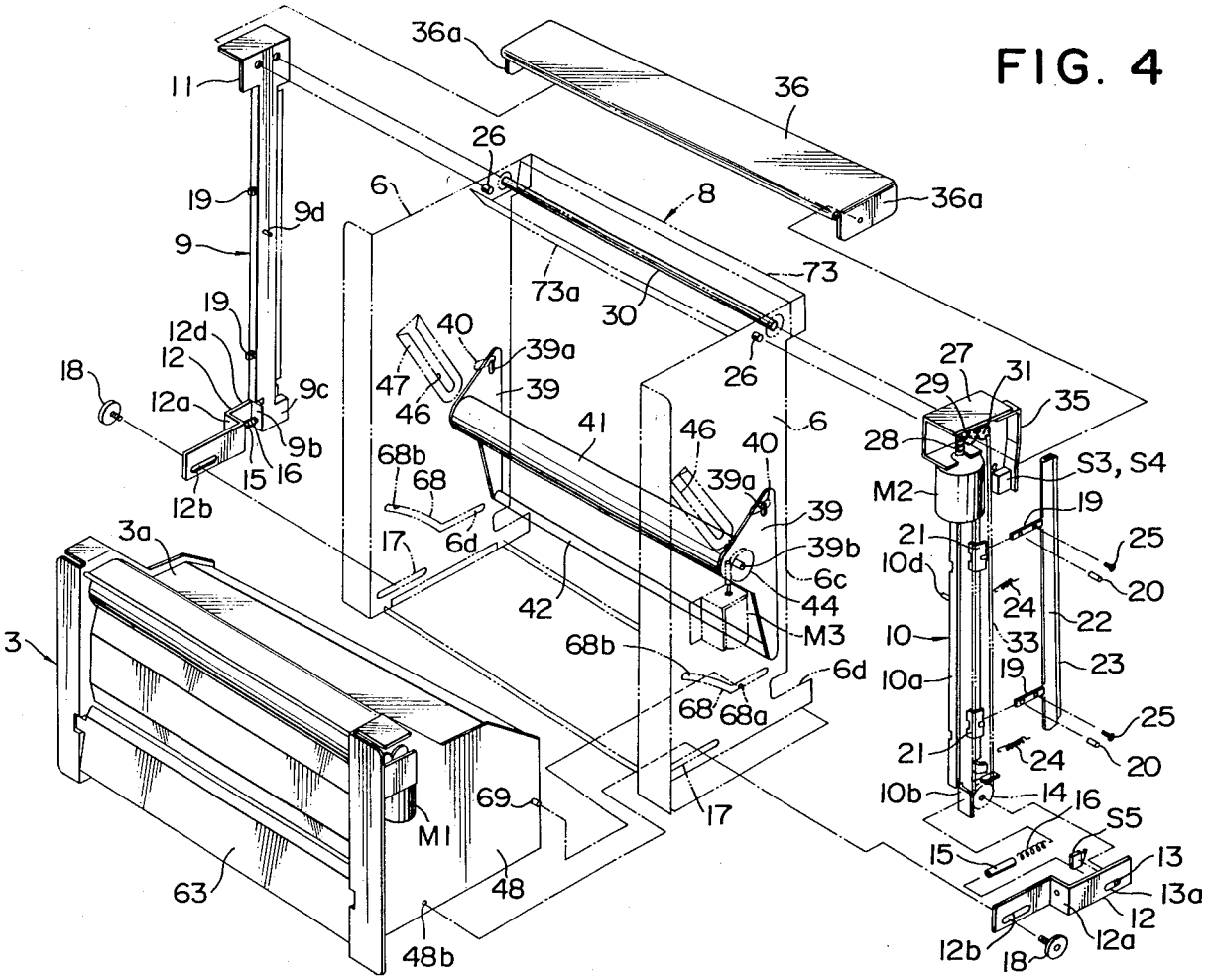
FIG. 4 is an exploded perspective view.

As shown by chain line in FIG. 4, the frame member 73 is integral with an elongated pan-like frame member **73*a* which surrounds the lower side of the shaft 30, so as to prevent the shaft 30 from contacting towel and other parts. On the other hand, the outer edge of each second flat portion 71*c* is orthogonally bent towards the main part 2, thus forming a flap 71*d***.

The distance between the flaps **71*d*, 71*d* is substantially equal to the distance between the outer edges of both frame members 12, 12 attached to the main part. The upper horizontal frame member 72 is fixed by, for example, spot welding, such that it extends between upper portions of the first flat portions 71*a*, 71*a* of the vertical frame members 71, 71 at a position slightly below the upper ends of the frame members 71, 71. The horizontal frame member 72 is provided on the upper end thereof with a bent portion 72***a* projecting towards the main part 2 and bent upward so as to exhibit an L-shaped cross-section. On the other hand, the lower edge of the upper horizontal frame member 72 is bent back inwardly, thus forming a bent-back portion 72*b*.

The lower horizontal frame member 72 is fixed by, for example, spot welding to the lower ends of the first flat portions 71*a*, 71*a* such that the lower end surface of the member 72 is flush with the lower edges of the flat portions 71*a*, 71*a*. Bent back portions 72*b*, 72*b* are formed both on the upper and lower ends of the lower horizontal frame member 72.

An aperture 74 is formed in the center of the upper horizontal frame member 72, while apertures 75 are formed on both longitudinal end portions of the lower frame member 72 so as to lap the first flat portions 71*a*, 71*a*.

For securing the mounting plate 5 having the described construction to a wall, a screw or a nail is driven through the aperture 74 in the upper horizontal frame member 72 into the wall, thus temporarily fixing the plate 5. In this state, the mounting plate 5 is suspended by the screw or nail driven through the aperture 74 so that it can be swung freely to the left and right. Then, the position of the mounting plate 5 is adjusted such that the vertical frame members 71 or the horizontal frame members 72 are aligned with suitable vertical or horizontal reference lines on the wall, so that the mounting plate 5 is correctly aligned. Then, screws or nails are driven into the apertures 75 formed in both ends of the lower horizontal frame member 72, so that the mounting plate 5 is firmly secured to the wall by the screws or nails driven through three apertures 74, 75.

Then, the main part of the towel dispenser is raised and hung from the mounting plate 5 such that the frame member 73 projected from the upper rear end of the main part receives the bent portion 72*a* of the upper frame member 72.

In this state,the flaps 71*d*, 71*d* of the vertical frame members 71 are positioned outside the frame members 12, 12 so that the main part of the towel dispenser is fixed against lateral movement.

Since the towel dispenser has a considerably heavy weight, it can be securely held on the wall although it is simply retained by and hung from the mounting plate 5. Thus, the towel dispenser can be detachably mounted without any risk for the towel dispenser to be oscillated or to come off during the use.

An explanation will be made hereinunder as to the operation of the embodiment having the described construction.

Figure 12A:
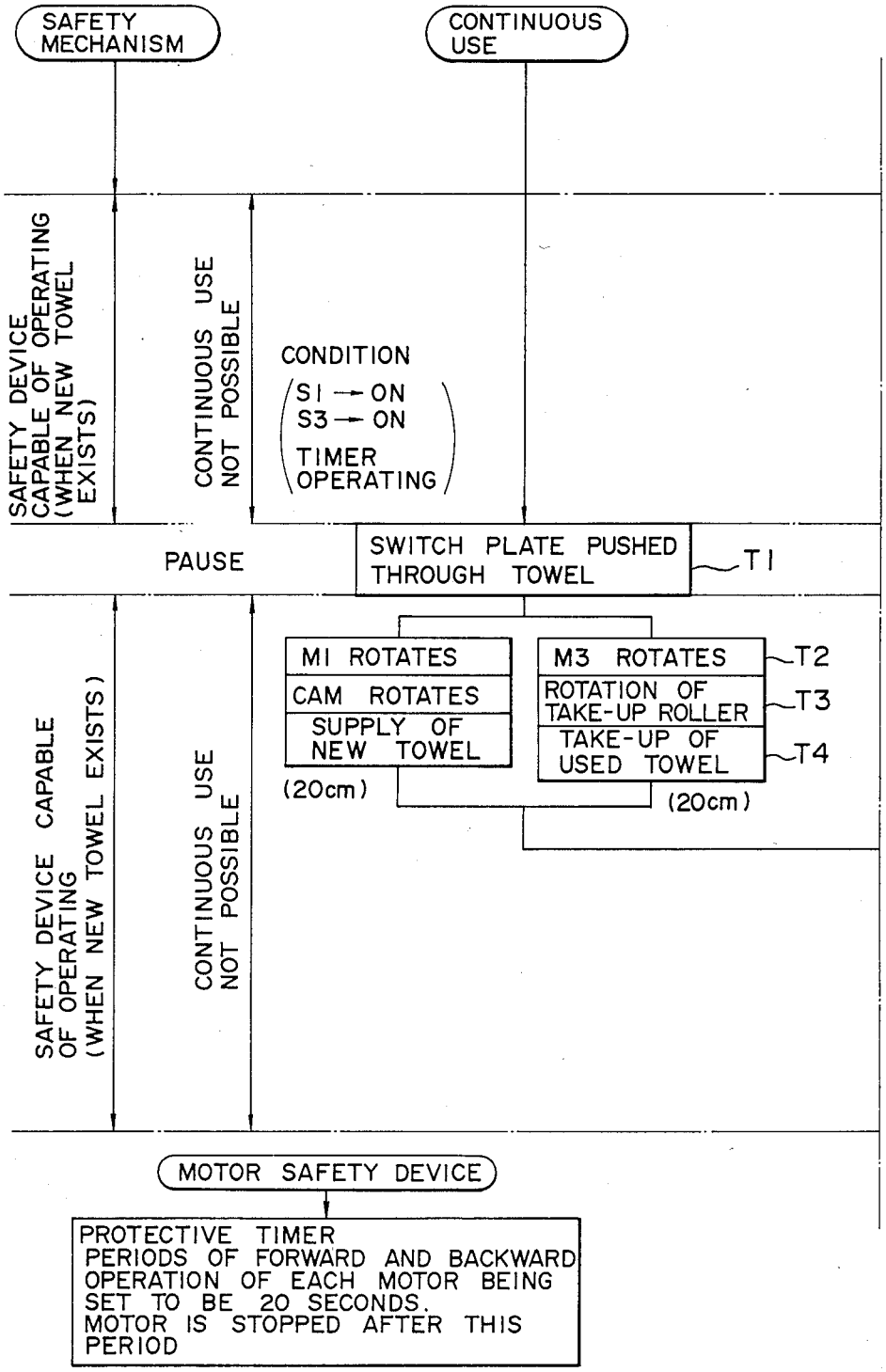
FIG. 12 is a flow chart illustrating the control operation.
Figure 12B:
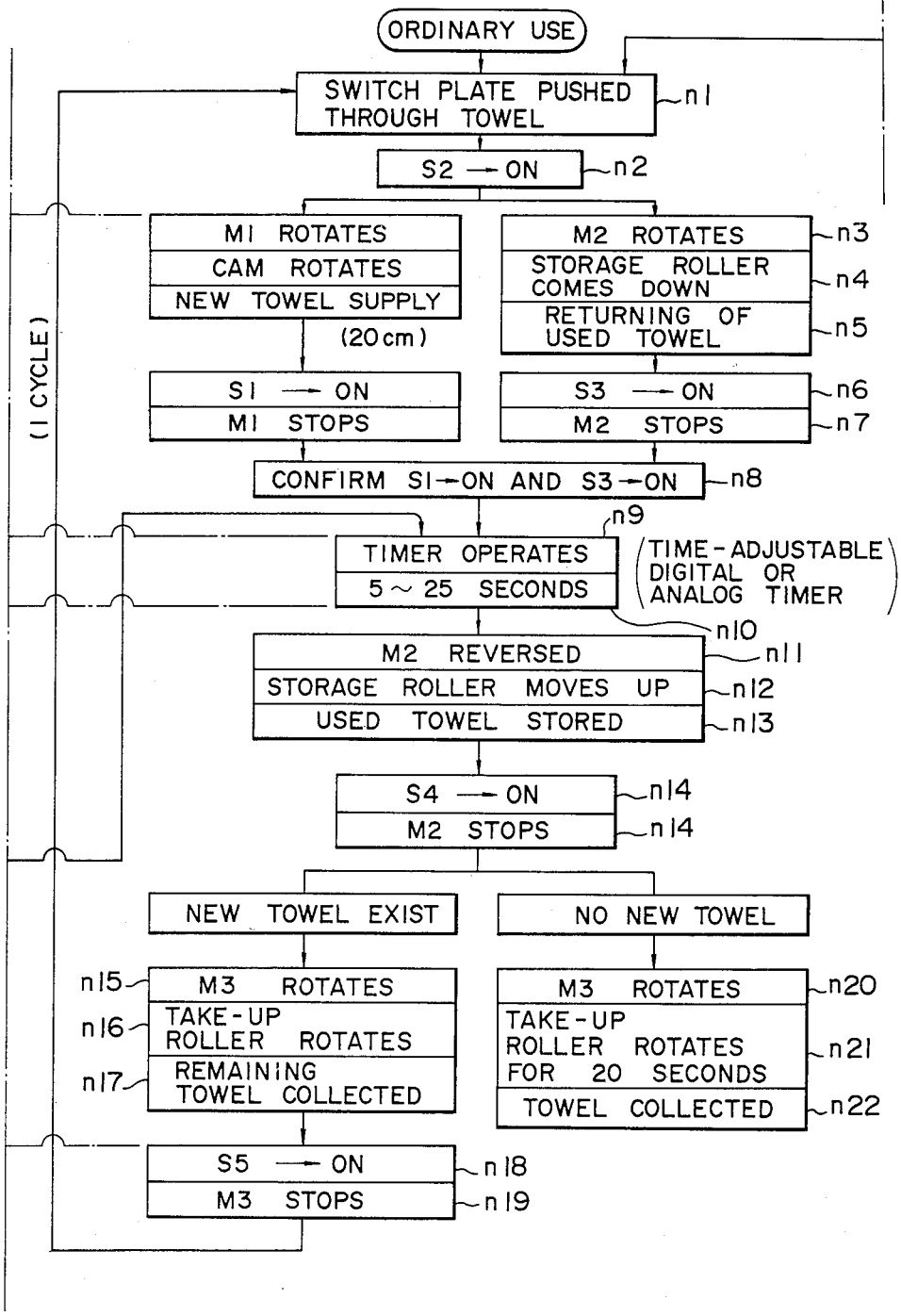
Figures 12, 12C:
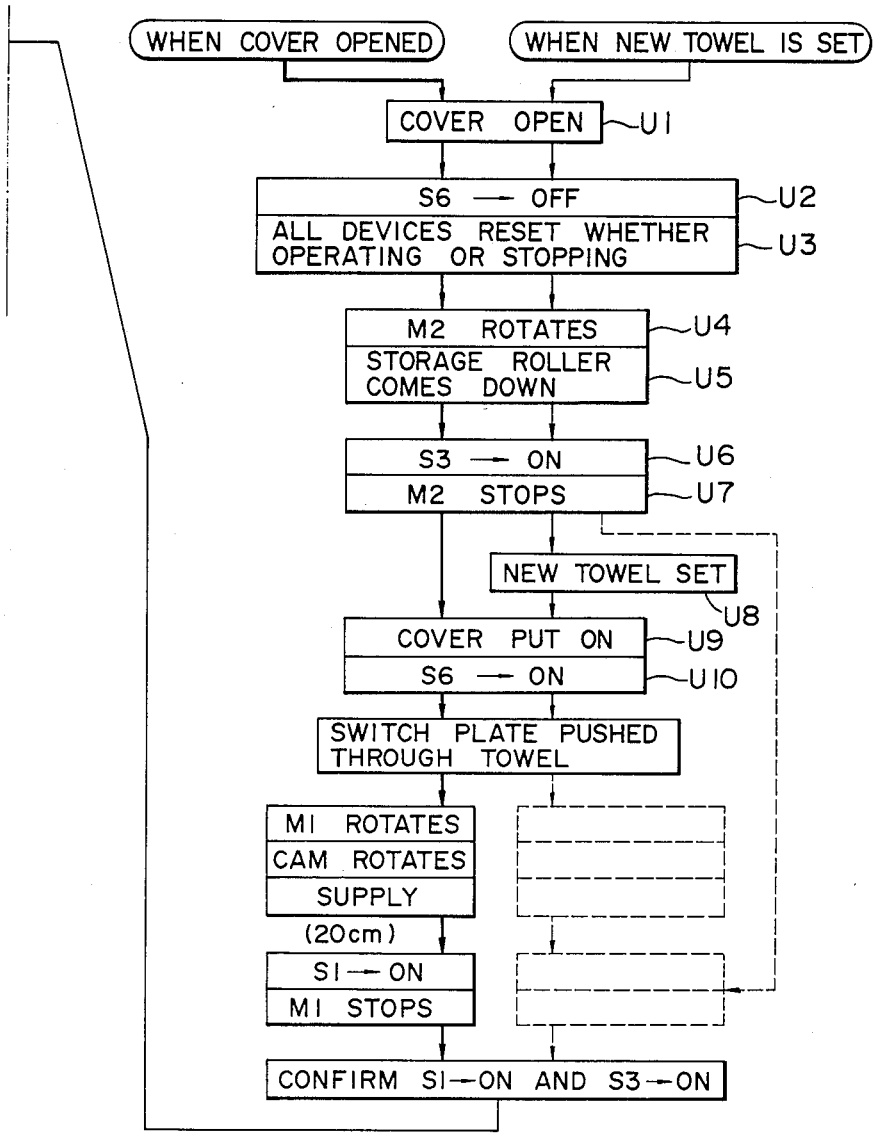

The description of the operation will proceed with specific reference to FIG. 12 which is a flow chart illustrating the control operation of the towel dispenser, and FIG. 13 onwards which are illustrations of operation of the towel dispenser.

Figure 13A:
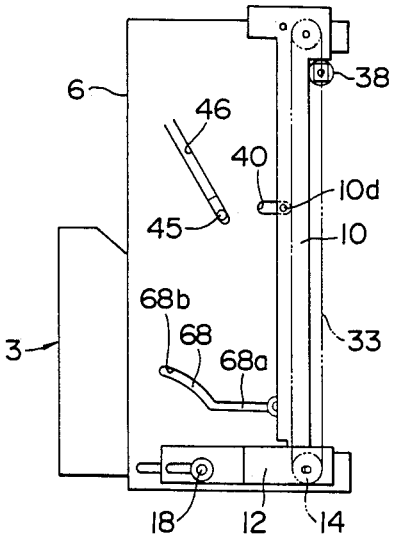
Figure 13B:
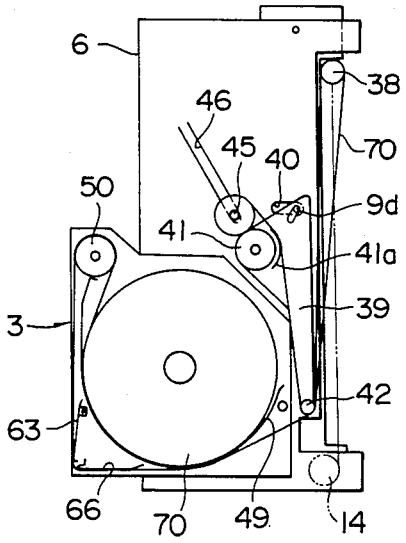
Figure 18:
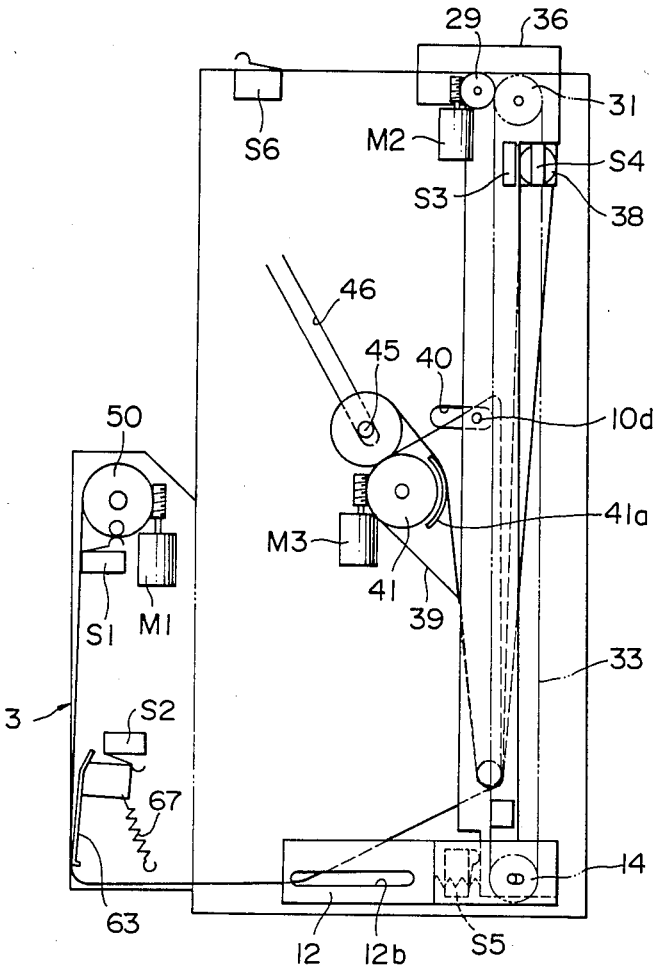
FIGS. 18 to 20 are side elevational views illustrating the operation of respective switches.

In the ordinary state of use, the towel 70 and various parts constituting the towel dispenser are arranged in a manner shown in FIGS. 13A and 13B and FIG. 18.

Namely, the towel receiver 3 is received in the frame 8. The leading end of the towel unrolled from the roll of the towel 70, which is received in the supporting frame 49 of the towel receiver 3, is led to the outside along the outer portion of the towel receiver 3 past the upper side of the supply roller 50 and, after contacting the surface of the switch plate 63, extends along the lower side of the frame plate 66 and, after contacting the lower surface of the supporting frame 49, leads to the adjusting roller 42. After making turn around the adjusting roller 42, the towel extends to the taxi roller 38 in the uppermost position of its stroke, and is wound around the latter from the inner to the outer sides thereof. The towel then leads again to the adjusting roller 42 so as to make a turn at the inner side of the towel portion leading from the supporting frame 49, and, after making contact with the guide 41*a* positioned on the rear side of the of the take-up roller 41, leads to the take-up shaft 45 which is in the lowermost position in the elongated holes 46, so as to be wound on the take-up shaft 45. In this state, the towel is wound at least once around the take-up shaft 45 and the take-up shaft 41 is held in this state in contact with the take-up roller 41.

Meanwhile, the rotary plate 39 is pressed by the tension of the towel 70 so as to be kept substantially perpendicularly, while the pins 9*d*, 10*d* are positioned in the upper ends of the elongated holes 39*a* and in the rear ends of the elongated holes 40. All the driving powers are off in this state.

Referring to FIG. 12, when the user pushes the switch plate 63 through the upper side of the towel 70 in Step n1, the limit switch S2 is turned on in step n2, so that the motors M1 and M2 start to rotate in Step n3.

As a result, in step n4, the motor M1 drives the supply roller 50 counter-clockwise as viewed in FIGS. 13 and 18, while the motor M2 causes the rudder chain 33 to run clockwise as viewed in FIG. 13, thereby lowering the taxi roller 38.

In consequence, a new portion of the towel is supplied and a used portion of the towel is taken-up in Step n2.

The amount of supply of the new towel portion is determined to be, for example, 20cm, by the cooperation between the limit switch S1 and the recess (cam) 52 which operates in accordance with the rotation of the supply roller 50.

In Step n6, limit switches S1 and S3 are turned on and the motors M1 and M2 are stopped in Step n7.

Figure 14A:
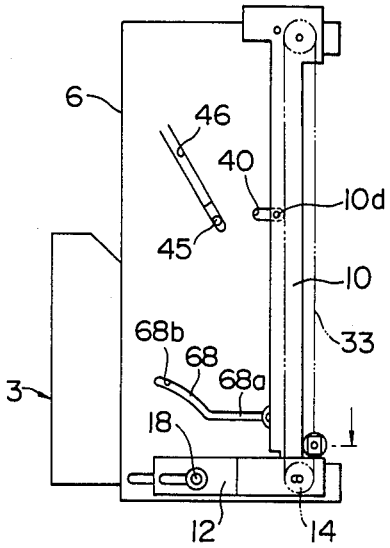
Figure 14B:
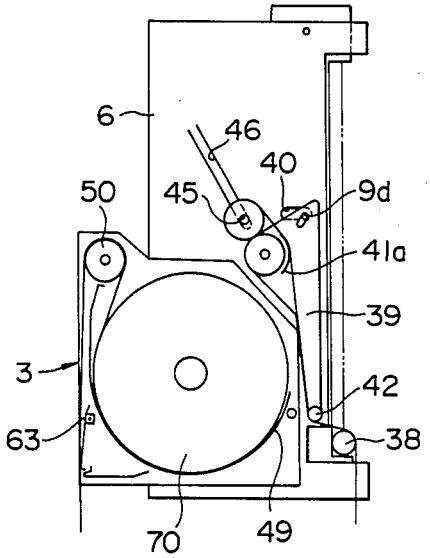
Figure 15A:
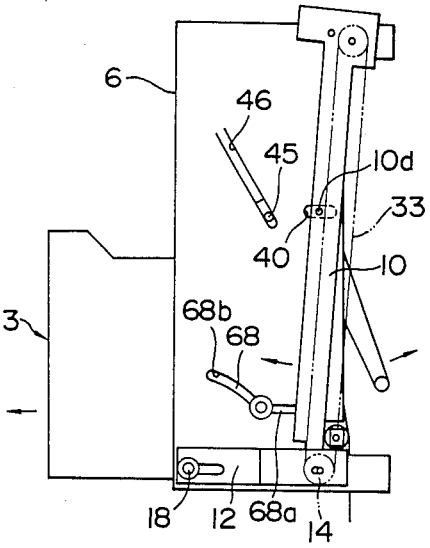
Figure 15B:
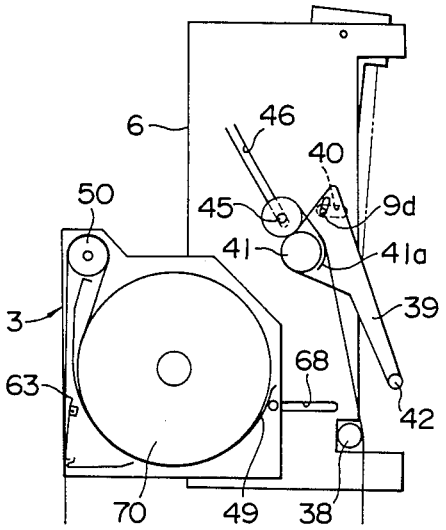
Figure 19:
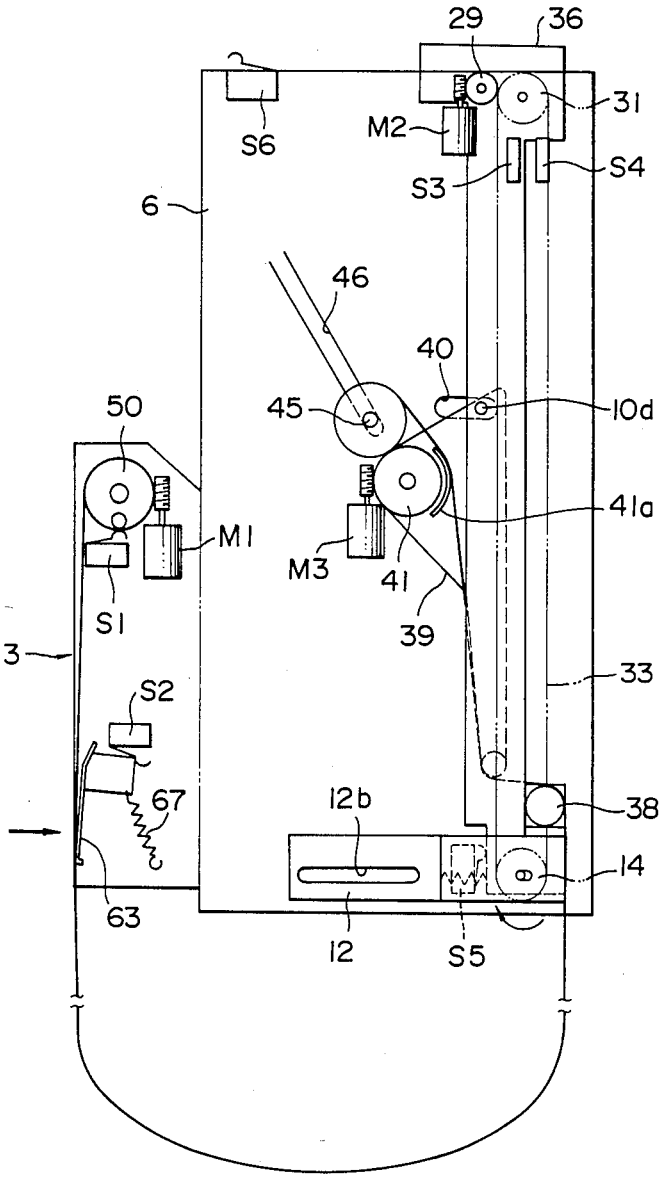

The towel dispenser in this state is shown in FIGS. 14A and 14B, as well as in FIG. 19. The towel is suspended in the form of a loop, with the used portion hidden behind the new portion of the towel. In Step n8, on states of the limit switches S1 and S3 are confirmed, so that a timer (not shown) starts to operate in Step n9. Subsequently, a count-up operation is commenced by the timer in Step n10 up to the value set in the timer.

The timer is provided on the printed circuit board P and can set a certain time suitable for the use to wipe his hands.

Figure 20:
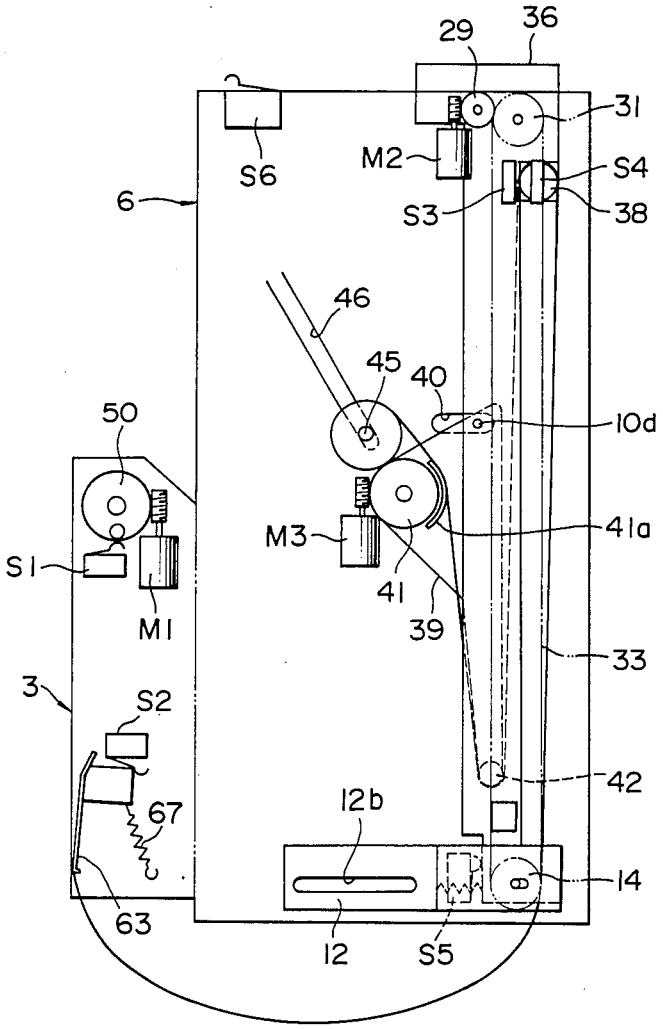

After elapse of this time, i.e., after the user has wiped the hands, the motor M2 starts to operate in the reverse direction so that the rudder chain 33 runs counterclockwise as viewed in FIG. 20, whereby the taxi roller 38 starts to rise so as to retract the used portion of the towel (Steps n12, n13).

When the taxi roller 38 has reached the uppermost end of the taxi roller 38, the limit switch S4 is turned on in Steps n13 and the motor M2 stops in Step n14.

If there still is unused towel portion, i.e., if the roll of the towel 70 has not been fully consumed, the process proceeds to Step n15 in which the limit switch S4 is turned on so as to start the motor M3, whereby the take-up roller 41 is rotated in the towel take-up direction thereby to take-up the used portion of the towel (Steps n16, n17).

As a result, the slack or the loop of the towel is extinguished so that the towel is tensioned with the result that the taxi roller 38, which is positioned in the upper stroke end thereof, is pressed downward by the towel which is wound around the taxi roller 38. In consequence, the rotary frames 9, 10 are pivoted about the pivot pins 26 such that their lower ends are swung forwardly, thereby turning the limit switch 5 on, thus stopping the motor M3 (Steps n18, n19). The process then returns to Step n1, so that the towel dispenser is held in stand-by state preparing for the next use of the towel. In the described embodiment, the following arrangement is adopted to ensure that the final step of the operation process is conducted without fail. Namely, a shaft (not shown) is laid between the lower ends of the rotary frames 9, 10 and the towel is led upward to the taxi roller 38 past the outer or rear side of this shaft. The tension applied to the towel serves also to push this shaft forwardly,so as to promote the forward swinging of the lower ends of the rotary frames 9, 10, thereby ensuring that the limit switch S5 is turned on. Such a shaft can be installed between the chain sprockets 14, 14 at the lower ends of the rotary frames 9, 10.

If there exists no towel after the stopping of the motor M2 in Step n14, i.e.,when the roll of the towel 70 has been fully consumed, the process proceeds to Step n20. In this Step n20, the motor M3 operates because the limit switch S4 has been turned on. In this case, however, the motor M3 continues to operate because the limit switch S5 is not turned off, unlike the case where there exists unused towel portion. However, since motor safety devices are incorporated such as to limit the motor operation time both in forward and backward direction to be, for example, 20 seconds, the motor M3 stops after operating for the limited operation time, during which the towel is completely taken-up. (Steps n21, n22)

In some cases, the towel dispenser is so busy that, immediately after a user has used the towel dispenser, the next user presses the switch plate before the used towel is taken-up.

In this case, as will be seen from FIG. 12, the towel dispenser does not operate at all because the operation is still in Step n11. However, if the switch plate 63 is pressed in Step T1 after operation of a timer, both the motors M1 and M2 start to operate in Step T2, so that both the supply roller 50 and the take-up roller 41 rotate in Step T3, whereby supply of new towel portion and the take-up of the used towel portion are conducted by an equal length of towel in Step T4. The process then proceeds to the control routine starting with Step n9.

When the cover 4 is opened, the following control process is executed. There are two cases in which the cover 4 is opened, namely, a first case in which the cover 4 is opened for the purpose of exchange of towels and a second case in which the cover is merely opened. In either case, the control operation as shown in FIG. 12 is conducted.

As the cover 4 is opened in Step U1, the limit switch S6 is turned off in Step U2, so that all functions are reset in Step U3. Then, in Step U4, the motor M2 starts to rotate and the taxi roller 38 starts to move down in Step U5.

As the taxi roller 38 moves downward, the limit switch S3 is turned on in Step U6, so that the motor M2 stops in Step U7.

Then, in Step U8, the towel is renewed or the interior of the towel dispenser is inspected. As the cover 4 is closed in Step U9, the limit switch S6 is turned on, so that all the functions are recovered to initiate the process from Step U10.

It may occur that the user wrongly pulls the towel at a moment at which the towel is just going to be retracted or taken-up by the taxi roller 38 or the take-up roll 41, so that a large tension is applied to the towel. This large tension is first applied to the taxi roller 38 tending to lower the latter. As a result, a torque is generated to rotate the rotary frames 9, 10 about the pins 26 such that the lower ends of the rotary frames are moved forwardly. This in turn causes, through the action of pins **9*d*, 10*d*, the rotary plates 39, 39 to operate such as to retract the adjusting roller 42 rearwardly around the take-up roller 41. This rearward movement of the adjusting roller 42 in turn promotes the forward movement of the rotary frames 9, 10. Due to the multiplication effect produced by the torque applied by the taxi roller 38 and the adjusting roller 42, the rotary frames 9, 10** are rotated without fail such that their lower ends project forwardly, so that the limit switch S5 is turned on to stop the motors M2,M3, thereby ceasing the take-up of the towel.

The above-described operation of the safety mechanism is illustrated in FIG. 12, and this operation is conducted only when new towel exists.

The renewal of the towel 70 essentially requires the demounting of used towel roll. To this end, all the functions are stopped by opening the cover 4, as explained before. Thereafter, the following process is taken in connection with the towe receiver 3.

Figure 16A:
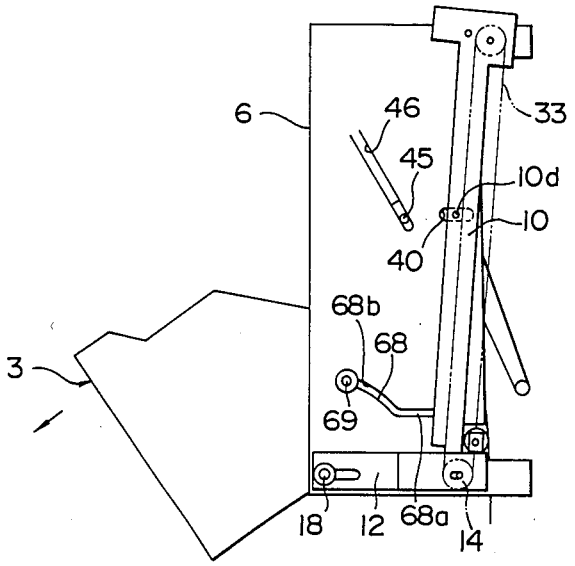
Figure 16B:
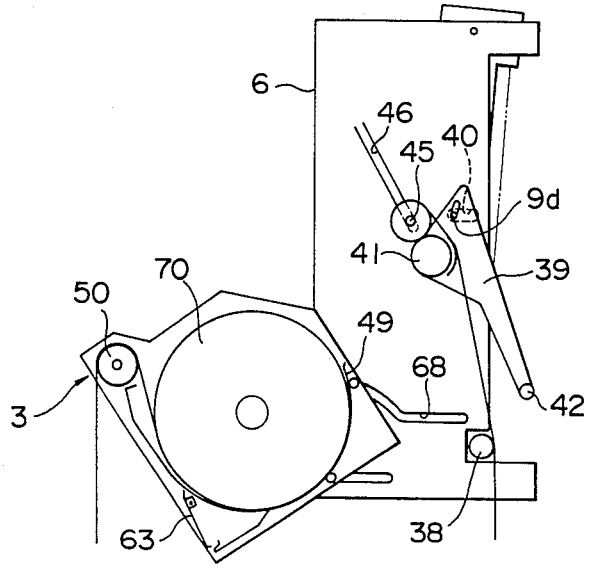
Figure 17A:
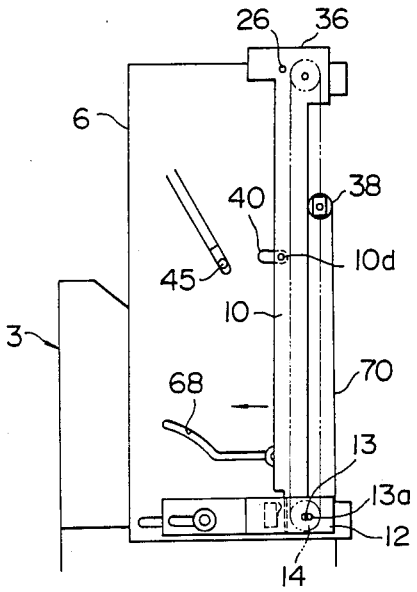
Figure 17B:
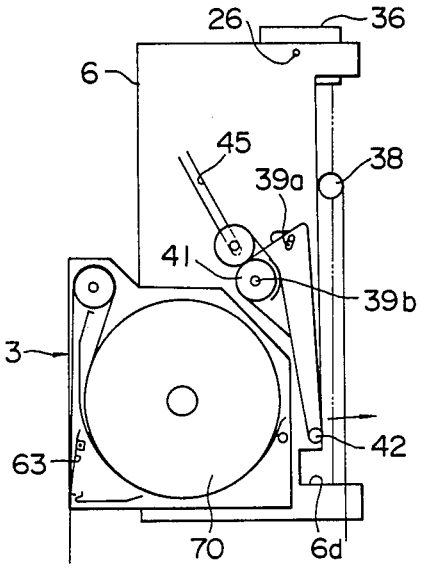

Namely, the towel receiver 3 is pulled forwardly as shown in FIGS. 15A, 15B and FIGS. 16A, 16B. In this state, the pins 69 move straight along the straight portions **68*a* of the elongated holes 68 formed in the side walls 6, 6, while the shaft 18 move forwardly along the elongated holes 12*b* in the frame 12 and the elongated holes 17 in the side walls 6,6. After fully extracting the towel receiver 3 forwardly, the user rotates the towel receiver 3 as a whole counterclockwise about the shaft 18 as shown in FIGS. 16A and 16B so that the pins 69 move along the arcuate portions 68*b* of the elongated holes 68, thus allowing the towel receiver 3** to be rotated and opened forwardly.

As a result of the rotation of the towel receiver 3, the frame 12, as well as the lower ends of the rotary frames 9, 10, are moved forwardly. In consequence, the pins **9*d*, 10*d* also are moved forwardly, so that the rotary plate 39, which has elongated holes 39*a* engaging with the pins 9*d*, 10*d*, is rotated counter-clockwise as shown in FIGS. 15A, 15B and FIGS. 16A, 16B. Consequently, the adjusting roller 42 is moved rearwardly of the frame 8**.

The rearward movement of the adjusting roller 42 in turn causes the space in the frame 8 to be opened, thereby facilitating the attaching of the new towel on the towel take-up shaft 45 and the placement of the new towel around the taxi roller 38.

After the renewal of the towel, the towel receiver 3 is returned to the original state and the cover 4 is closed so that the towel dispenser becomes ready to start to perform the operation shown in FIG. 12.

During the upward and downward movement of the taxi roller 38, it is held in frictional engagement with the friction members 23 so as to be forcibly rotated by the latter. Therefore, the retraction of the used towel portion can be conducted smoothly with minimal friction with the taxi roller. In addition since only the small-diameter end portions 38*a*, 38*a* of the taxi roller 38 contact the friction members 23,the central portion 38*b* of the taxi roller 38 rotate at a high peripheral speed so as to forcibly deliver and take-up the towel thereon at a high speed. Therefore, even when the clearance between the taxi roller 38 and the rear plate (not shown) of the towel dispenser is small, the towel can be supplied and retracted smoothly without any risk of folding or being caught in the clearance due to friction which is possible to occur between the towel and the rear plate.

More specifically, during downward movement of the taxi roller 38, the central portion of the taxi roller 38 rotates at a high peripheral speed in the direction for downwardly feeding the towel, so that the portion of the towel between the adjusting roller and the taxi roller is tensed. In consequence,the towel can closely contact with the peripheral surface of the towel, so that the taxi roller cans supply the towel downward with increased frictional force, thus eliminating any tendency for the towel to be slacked inside the towel dispenser.

Conversely, when the taxi roller is moving upward, the taxi roller 38 releases the towel towards the adjusting roller at a high speed, so that the tension in the towel running towards the take-up roller is decreased to enable the take-up roller to take-up the towel without fail at a reduced torque.

From the foregoing description, it will be understood that both axial ends of the shaft carrying the roll of the used portion of the towel and/or the shaft carrying the unused portion of the towel are supported by tabs which are bent inwardly from both side walls and, therefore, do not project beyond the side walls, so that electronic and mechanical parts can be mounted on the outer surfaces of the side walls densely. In addition, the inwardly bent tabs serve as ribs so that mechanical strength of the side walls are appreciably increased. This shaft supporting structure can be used for the purpose of supporting a roll of towel, regardless of whether the towel dispenser is of manual operation type or electrically driven type.

It is to be understood also that, since the end surface of the rolled towel is contacted only by the adjacent tab, the frictional resistance against the rotation is remarkably reduced as compared with the known arrangement in which the whole area of the roll end surface is contacted by the adjacent side wall. Furthermore, the tabs effectively prevent the roll from being axially collapsed, thus enabling the towel to be rolled in a neat form with flattened axial end surfaces.

In addition, when the towel is to be replaced, the adjusting roller is moved to a position where it does not hinder the placement of the towel around various shafts, by widening the space through which the towel is set. In consequence, the mounting of new towel is very much facilitated to enable even a person who is unfamiliar with this machine, Furthermore, the taxi roller is forcibly driven upon frictional engagement with the friction members, so as to retract or deliver the towel forcibly, thus enabling the towel to be retracted and delivered smoothly. In addition, even when the towel dispenser has a rear wall which is positioned in the close proximity of the towel, i.e., even when the towel is obliged to move up and down through an extremely small gap, the undesirable separation of the towel from the taxi roller and consequent stagnation in the narrow space is avoided, thanks to the fact that the taxi roller is driven forwardly and backwardly so as to forcibly supply and retract the towel. This in turn enables the above-mentioned gap to be reduced, thus allowing the towel dispenser as a whole to have a reduced size.

It is to be noted also that the rotary frames supporting the taxi roller are moved together with the taxi roller, so as to facilitate the placement of the new towel around various shafts and rollers.

Finally, the safety arrangement, when an undue force is applied to the towel, stops the motor to prevent movement of the taxi roller, so that the driving system including the motor is protected against overload.

What is claimed is:

1. A towel dispenser for storing and supplying in longitudinally successive increments, a towel of indeterminate length, said dispenser including:

a holder for a convolutely-wound, multiple-increment roll of said towel on a shaft which has respective end portions protruding from each of two axially-opposite ends of said roll by respective predetermined amounts, said holder including:

a pair of opposed side walls which are laterally spaced from one another;

means for mounting said sidewalls so that they extend in respective planes which are oriented vertically and extend in a forward-rearward direction, relative to said dispenser;

said two sidewalls at corresponding locations located intermediate the vertical and front-to-rear extents of said sidewalls and wholly bounded by outer peripheries of the respective sidewalls, being provided with respective slots which are elongated obliquely so as to extend upwardly-forwardly and downwardly-rearwardly, so as to have an upper end and a lower end;

each said slot being defined by a corresponding opening formed through the respective sidewall, each opening having a perimetrically-extending edge, each said sidewall perimetrically of the respective opening except at the upper end thereof, being bounded by a medially-bent flange, said edges, except at said upper ends, thereby lying more medially of said dispenser than said respective planes of said sidewalls by an amount which is at least as great as the sum of said predetermined amounts by which said shaft end portions protrude from said roll of towel, and means defining an upwardly and forwardly-accessible entrance into and exit from said slots at said upper ends, so that said roll of towel, on said shaft, while being held horizontally and axially aligned transversally of said dispenser, may be installed in and removed from said holder from frontally of said dispenser, by respectively sliding said shaft protruding end portions down into and up out of said slots through said entrance and exit means.

2. A towel dispenser for storing and longitudinally successive increments, a towel of indeterminate length, said dispenser including:

a holder for a convolutely-wound, multiple-increment roll of said towel on a shaft which has respective end portions protruding from each of two axially-opposite ends of said roll by respective predetermined amounts, said holder including:

a pair of opposed side walls which are laterally spaced from one another;

means for mounting said sidewalls so that they extend in respective planes which are oriented vertically and extend in a forward-rearward direction, relative to said dispenser;

said two sidewalls at corresponding locations located intermediate the vertical and front-to-rear extents of said sidewalls and wholly bounded by outer peripheries of the respective sidewalls, being provided with respective means for removably holding said shaft protruding end portions while permitting rotation of said shaft while held by said holding means;

a frame including said sidewalls;

a towel receiver movably mounted to said frame for forward-rearward opening-closing movement in relation to said frame;

means for mounting a second convolute-wound, multi-increment roll of said towel in said receiver, with access to said second roll being gainable by opening of said towel receiver by forward movement of said towel receiver in relation to said frame;

a pair of generally vertically-oriented frame elements mounted on laterally opposite outer sides of said sidewalls by mounting means permitting limited pivotal movement about respective corresponding upper transverse axes;

a taxi roller mounted horizontally, transversally between said frame elements for movement vertically therealong between upper and lower positions;

motor means operatively connected with said taxi roller and operable for moving said taxi roller between said upper and lower positions;

a pair of plates disposed facewise adjacent respective opposite medial sides of said sidewalls and mounted at corresponding sites to respective ones of said vertically-oriented frame elements through respective slots in said sidewalls, these slots being so oriented that when said vertically-oriented frame elements are pivoted forwards about said upper transverse axes, said plates are pivoted upwardly forwards and downwardly rearwards in respective upper and lower segments thereof;

an adjusting roller rotatably mounted horizontally, transversally between corresponding sites on said lower sements of said plate;

a take-up roller rotatably mounted horizontally, transversally between said plates above said adjusting roller and disposed for roller-to-roller peripheral driving engagement with the first-mentioned roll of towel, a towel travel path being thereby defined extending from said second roll of towel, part-way around said taxi roller, doubling over said taxi roller, part-way around said adjusting roller a second time, past said take-up roller and onto said first-mentioned roll of towel;

motor means operatively connected with said take-up roller for driving said take-up roller for rotating said first-mentioned roll of towel;

means mechanically interconnecting said generally vertically-oriented frame elements with said towel receiver, so that as said towel receiver is moved outward in relation to said frame for gaining access to said second roll, said generally vertically-oriented frame elements are rotated forwardly about said upper transverse axes, causing said plates in said lower segments thereof to pivot rearwards, thus moving said adjusting roller rearwards relative to an imaginary plane containing said upper and lower positions of said taxi roller, and so that as said towel receiver is moved inward in relation to said frame, said generally vertically-oriented frame elements are rotated rearwardly about said upper transverse axes, causing said plates in said lower segments thereof to pivot forwards, thus moving said adjusting roller forwards relative to said imaginary plane containing said upper and lower positions of said taxi roller, whereby said towel travel path is opened-up and made accessible for easier servicing as said towel receiver is moved outward in relation to said frame, and is rendered more compact as said towel receiver is moved inward in relation to said frame.

3. A towel dispenser for storing and supplying in longitudinally successive increments, a towel of indeterminate length, said dispenser including:

first means for rotatably mounting a supply roll for fresh towel, and second means for rotatably mounting a take-up roll for used towel, said first and second roll mounting means being spaced apart to provide a towel travel path;

first means for rotating said first roll mounting means, and second means for rotating said second roll mounting means so as to provide greater and less amounts of towel in said towel travel path;

a taxi roller;

means rotatably mounting said taxi roller for generally vertical movement between an upper position and a lower position, said taxi roller mounting means so disposing said taxi roller in relation to said towel travel path, that as said taxi roller is raised said taxi roller engages said towel between said supply and take-up rolls and takes-up slack is said amount of towel in said towel travel path;

means for raising and lowering said taxi roller between said upper and lower positions thereof; and at least one vertically-elongated friction member disposed in rolled-upon engagement with said taxi roller, so that as said taxi roller is at least one of raised and lowered by said raising and lowering means, said taxi roller is correspondingly rotated by contact with said at least one friction member.

4. A towel dispenser for storing and supplying in longitudinally successive increments, a towel of indeterminate length, said dispenser including:

a holder for a convolutely-wound, multiple-increment roll of said towel on a shaft which has respective end portions protruding from each of two axially-opposite ends of said roll by respective predetermined amounts, said holder including:

a pair of opposed side walls which are laterally spaced from one another;

means for mounting said sidewalls so that they extend in respective planes which are oriented vertically and extend in a forward-rearward direction, relative to said dispenser;

said two sidewalls at corresponding locations located intermediate the vertical and front-to-rear extents of said sidewalls and wholly bounded by outer peripheries of the respective sidewalls, being provided with respective means for removably holding said shaft protruding end portions while permitting rotation of said shaft while held by said holding means;

a frame including said sidewalls;

a towel receiver movably mounted to said frame for forward-rearward opening-closing movement in relation to said frame;

means for mounting a second convolute-wound, multi-increment roll of said towel in said receiver, with access to said second roll being gainable by opening of said towel receiver by forward movement of said towel receiver in relation to said frame;

a pair of generally vertically-oriented frame elements mounted on laterally opposite outer sides of said sidewalls by mounting means permitting limited pivotal movement about respective corresponding upper transverse axes;

a taxi roller mounted horizontally, transversally between said frame elements for movement vertically therealong between upper and lower positions;

motor means operatively connected with said taxi roller and operable for moving said taxi roller between said upper and lower positions;

a pair of plates disposed facewise adjacent respective opposite medial sides of said sidewalls and mounted at corresponding sites to respective ones of said vertically-oriented frame elements through respective slots in said sidewalls, these slots being so oriented that when said vertically-oriented frame elements are pivoted forwards about said upper transverse axes, said plates are pivoted upwardly forwards and downwardly rearwards in respective upper and lower segments thereof;

means for rotating the first-mentioned roll for winding used towel thereonto, a travel path being defined extending from said second roll of towel, over said taxi roller and onto said first-mentioned roll of towel;

means mechanically interconnecting said generally vertically-oriented frame elements with said towel receiver, so that as said towel receiver is moved outward in relation to said frame for gaining access to said second roll, said generally vertically-oriented frame elements are rotated forwardly about said upper transverse axes causing said plates in said upper segments thereof to pivot forwards, and so that as said towel receiver is moved inward in relation to said frame, said generally vertically-oriented frame elements are rotated rearwardly about said upper transverse axes, causing said plates in said upper segments thereof to pivot rearwards, whereby said towel travel path is opened-up and made accessible for easier servicing as said towel receiver is moved outward in relation to said frame, and is rendered more compact as said towel receiver is moved inward in relation to said frame.

5. A towel dispenser for storing and supplying in longitudinally successive increments, a towel of indeterminate length, said dispenser including:

first means for rotatably mounting a supply roll for fresh towel, and second means for rotatably mounting a take-up roll for used towel, said first and second roll mounting means being spaced apart to provide a towel travel path;

first means for rotating said first roll mounting means, and second means for rotating said second roll mounting means so as to provide greater and less amounts of towel in said towel travel path;

a taxi roller;

means rotatably mounting said taxi roller for generally vertical movement between an upper position and a lower position, said taxi roller mounting means so disposing said taxi roller in relation to said towel travel path, that as said taxi roller is raised said taxi roller engages said towel between said supply and take-up rolls and takes-up slack in said amount of towel in said towel travel path;

means for raising and lowering said taxi roller between said upper and lower positions thereof;

a frame supporting said first means for rotatably mounting said supply roll and said second means for rotatably mounting said take-up roll;

means movingly responsive to user-pulling on said towels between said supply roll and said taxi roller, movably mounting said means for rotatably mounting said taxi roller, to said frame;

said means for raising and lowering said taxi roller including an electric motor means which, when operating, raises and lowers said taxi roller, and a switch means operatively connective between said motor means and said means for rotating said taxi roller, for interrupting power to said motor means if a user pulls sufficiently strongly on said towel between said taxi roller and said supply roll to move said movably mounting means by an amount sufficient to cause actuation of said switch means.

* * * * *